United States Patent [19]

Lopez et al.

[11] Patent Number: 4,724,440

[45] Date of Patent: Feb. 9, 1988

[54] BEAM STEERING UNIT REAL TIME ANGULAR MONITOR

[75] Inventors: Alfred R. Lopez, Commack; Paul H. Feldman, Center Moriches, both of N.Y.

[73] Assignee: Hazeltine Corporation, Greenlawn, N.Y.

[21] Appl. No.: 868,497

[22] Filed: May 30, 1986

[51] Int. Cl.[4] ..... H01Q 3/22

[52] U.S. Cl. ..... 342/368; 342/377; 342/169; 342/173

[58] Field of Search ..... 342/368, 372, 169, 173, 342/377

[56] References Cited

U.S. PATENT DOCUMENTS

| | | | |
|---|---|---|---|
| H173 | 12/1986 | Claborn et al. | 342/173 X |
| 3,478,358 | 11/1969 | Trigon | 342/377 X |
| 3,478,359 | 11/1969 | Salmon | 342/377 |
| 3,482,245 | 12/1969 | Parquier | 342/377 X |
| 4,008,476 | 2/1977 | Evans, Jr. | 342/169 |
| 4,160,975 | 7/1979 | Steudel | 342/377 X |
| 4,166,274 | 8/1979 | Reudink et al. | 342/377 X |
| 4,176,354 | 11/1979 | Hsiao et al. | 342/173 |
| 4,229,739 | 10/1980 | Smith | 342/377 |
| 4,423,418 | 12/1983 | Pearlman | 342/169 |
| 4,445,119 | 4/1984 | Works | 342/377 |
| 4,477,812 | 10/1984 | Frisbee, Jr. et al. | 342/377 X |
| 4,520,361 | 5/1985 | Frazita | 342/372 |
| 4,532,517 | 7/1985 | LaBerge et al. | 342/372 |
| 4,532,518 | 7/1985 | Gaglione et al. | 342/372 |
| 4,532,519 | 7/1985 | Rudish et al. | 342/372 |
| 4,536,766 | 8/1985 | Frazita | 342/372 |
| 4,688,045 | 8/1987 | Knudsen | 342/377 |

*Primary Examiner*—Theodore M. Blum
*Assistant Examiner*—John B. Sotomayor
*Attorney, Agent, or Firm*—E. A. Onders

[57] ABSTRACT

Proper operation of a beam steering unit for a phase array antenna, is verified by simulating the pattern of wave energy which would be radiated to an observation point in space when the beam steering unit is connected to phase shifters associated with elements of the antenna. The simulated pattern thus obtained may be compared with a preset pattern for the observation point during a scanning operation of the beam steering unit, and an alarm or other indication is obtained when the difference between the simulated and the preset pattern exceeds a certain limit. The simulated pattern is obtained by storing phase angle data from the beam steering unit in a memory at areas corresponding to phase shifters associated with elements of the phased array antenna.

Observation angle data corresponding to the angle of the point in space relative to the antenna array is generated, the observation angle data being a function of observation angle, antenna element spacing and radiation wavelength.

11 Claims, 3 Drawing Figures

BEAM STEERING UNIT REAL TIME ANGULAR MONITOR

BACKGROUND OF THE INVENTION

1. Field of the Invention

The present invention relates to a method of and a system for monitoring the operation of a beam steering unit for a phased array antenna, during a scanning operation of the beam steering unit. In particular, according to the invention, the pattern of wave energy which would be radiated from the antenna to an observation point in space during the scanning operation is simulated by processing phase angle data provided by the beam steering unit and combining it with observation angle data corresponding to the observation point.

2. Description of the Known Art

In order to verify proper operation of a beam steering unit associated with a scanning phased array antenna, it has ordinarily been required to monitor the wave energy actually radiated by the antenna to near and/or far observation point, and then compare the monitored energy levels with a reference standard. For example, in U.S. Pat. No. 4,520,361 issued May 28, 1985, to R. F. Frazita and assigned to the assignee of the present invention, phase angle data provided from a beam steering unit to each of a number of radiating elements of a phased array antenna, is verified separately for each of the elements by coupling some of the element radiation to a manifold at the antenna, mixing the manifold output with a sample of the RF power source to obtain a beat frequency signal, and measuring the phase shift between the beat frequency signal and a reference pattern signal.

U.S. Pat. No. 4,536,766 issued Aug. 20, 1985, to R. F. Frazita and assigned to the assignee of the present invention, discloses a beam pointing correction arrangement which also entails the use of a manifold proximate the radiating elements of a scanning phased array antenna, wherein the manifold output is detected and decoded to provide an indication of the actual beam pointing angle. The start and stop time of the beam steering unit scanning operation is then adjusted to eliminate or minimize any detected beam pointing error. A system is also known from U.S. Pat. No. 4,532,517 issued July 30, 1985, in which output data from a beam steering unit is subjected to a cyclic redundancy check employing algebraic methods commonly used to verify accuracy of information transmitted in digital form.

As far as is known, no method or system has been disclosed by which the pattern of wave energy radiated from a phased array antenna to an observation point during operation of an associated beam steering unit, can be simulated to allow for a comparison with a standard reference pattern. The desirability for such a method or system is especially great in microwave landing systems (MLS) in which precise timing of the beam steering operation must be maintained continuously to assure that an aircraft at a certain point in space relative to the system antennas will receive the antenna beams at the proper timings as the antenna beams are scanned "to and fro" and "up and down".

Basically, a MLS employs at least two phased array antennas each having a number of equally spaced radiating elements which are excited with microwave energy at a generally uniform amplitude but at a phase determined by the setting of individual phase shifters associated with the elements. The function of setting the phase shifts for the individual phase shifters is accomplished by the beam steering unit (BSU). As is well-understood by those skilled in the art, a main energy beam which is radiated from the excited antenna elements can be steered or scanned in a direction relative to the antenna, in accordance with predetermined incremental changes of the phase shifters by the BSU over successive time intervals.

In MLS applications, an azimuth (AZ) phased array antenna scans its radiated beam to and fro periodically in the horizontal direction, the beam-width being relatively broad in the vertical direction but narrow in the horizontal direction, so that an aircraft within the scanning Field of the AZ antenna will be able to detect a passage of the scanning beam from the AZ antenna from ground level to a relatively high altitude. An elevation (EL) phased array antenna scans its beam up and down periodically in the vertical direction, the beam width being relatively broad in the horizontal direction but narrow in the vertical direction, so that an aircraft within the scanning field of the EL antenna will be able to detect the passage of the scanning beam from the EL antenna from an approach which is head-on to the antenna to one which is about ±40° relative to the antenna axis.

Prior to a scanning operation of the AZ antenna, a "preamble" signal is radiated broadly from a third antenna for reception by an aircraft within the operating range of the MLS. The preamble signifies, inter alia, that a horizontal scan of the beam from the AZ antenna is to begin at a certain time from one side (e.g., −40°) of the AZ antenna, to the opposite side (+40°), and back again to the starting side (−40°). Equipment on board the aircraft detects and decodes the preamble, and counts the time period between reception of the beam from the AZ antenna on its "to" scan and reception of the beam on the "fro" scan. The counted time difference corresponds to a unique azimuth heading of the aircraft relative to the AZ antenna. The MLS then broadly radiates a preamble signifying that a scanning operation of the EL antenna is about to begin and, by a corresponding time difference counting operation, the equipment on board the aircraft determines a unique elevation angle for the craft relative to the EL antenna. Since both the AZ and EL antennas are located in the vicinity of a runway employing the MLS, the aircraft pilot thus receives information which is critical to assure a proper glide path for a safe landing on the runway.

From the foregoing, it will be appreciated that precise timing of the scanning operations of both the AZ and EL antennas is essential to ensure accurate glide path information will be provided to the aircraft pilot. Any malfunction which results in a deviation of the time difference between to and fro or up and down scanning beams at a given point in space, from a predetermined difference which defines the location of the point in space when the MLS is functioning properly, will cause the on-board equipment to produce erroneous heading information.

A major source of such potential system malfunction is the BSU which controls the direction and rate of scan of the beams from the AZ and EL antennas in the MLS. Thus, it is imperative that the BSU be monitored continuously with respect to the phase angle data which it provides to the phase shifters associated with the antenna elements, causing the beams to be swept at the desired predetermined rates.

SUMMARY OF THE INVENTION

An object of the present invention is to overcome the above and other shortcomings in the known techniques by which operation of a BSU can be monitored in real time.

Another object of the invention is to provide a technique by which the accuracy of the BSU can be ascertained without providing field monitors in the vicinity of or at points located remote from the antenna with which the BSU is associated.

A further object of the invention is to simulate, in real time, the pattern of wave energy which would be radiated to an aircraft from a MLS antenna during operation of the associated BSU.

A further object of the invention is to simulate, in real time, the scanning of a beam of a MLS antenna as received by an aircraft at a certain point in space during a scanning operation of the BSU, and to compare the time difference between successive beams with a preset time difference to confirm proper operation of the BSU.

According to one aspect of the present invention, a method of simulating the pattern of wave energy which would be radiated to an observation point in space from a scanning phased array antenna during operation of the BSU, includes storing initial phase angle data in memory areas each of which corresponds to a phase shifter to be driven by the BSU, sequentially reading out phase angle data from the memory areas and updating the phase angle data from each area according to the phase angle data from the BSU and storing the updated phase angle data in the corresponding memory areas, selecting a desired observation angle relative to the antenna whereat the wave energy pattern radiated from the antenna to a point at the observation angle is to be simulated and generating observation angle data which is related to (a) the desired observation angle, (b) the distance between adjacent antenna elements and (c) the wavelength of the wave energy, combining the updated phase angle data with the observation angle data and producing composite angle data functionally related to the combined data, subtracting from the composite angle data for a time interval of the BSU operation, the composite angle data for the immediately preceding time interval and accumulating resulting differences with initial value composite angle data to provide accumulated composite angle data, and determining the relative amplitude of wave energy which would be radiated to the point at the desired observation angle during BSU operation as a function of the accumulated composite angle data.

According to another aspect of the invention, a system for testing the operation of a BSU by simulating the wave energy pattern which would be radiated to an observation point from a scanning phased array antenna having phase shifters associated with equally spaced elements of the antenna, includes memory means for storing phase angle data provided by the BSU at certain time intervals in memory areas each corresponding to a phase shifter to be driven by the BSU, logic means coupled to the memory means and adapted to be responsive to the phase angle data from the BSU for addressing and controlling data flow in and out of the memory areas, the logic means including means to set initial phase angle data in the areas of the memory means to correspond with initial phase settings for the phase shifters, data increment means coupled to the memory means for updating the value of phase angle data when read out of each of the memory areas according to the phase angle data from the BSU, wherein the updated phase angle data is stored in corresponding memory areas for each time interval, means for generating observation angle data according to a selected angle at which the observation point is located relative to the antenna, the observation angle data being functionally related to the selected observation angle, the spacing between adjacent antenna elements and the wavelength of the wave energy, means coupled to the data increment means and the observation angle data generating means for combining the updated phase angle data with the observation angle data, and producing composite angle data as a function of the combined data, means for subtracting from the composite angle data for each time interval the composite angle data for the immediately preceding time interval, means coupled to the subtracting means for accumulating resulting differences with initial value composite angle data to produce accumulated composite angle data, and means for determining the relative amplitude of wave energy which would be radiated to the observation point during scanning of the BSU according to the accumulated composite angle data, and for producing a corresponding output.

For a better understanding of the present invention, together with other and further objects, reference is made to the following description taken in conjunction with the accompanying drawing, and the scope of the present invention will be pointed out in the appended claims.

DETAILED DESCRIPTION OF THE INVENTION

Figure 1:
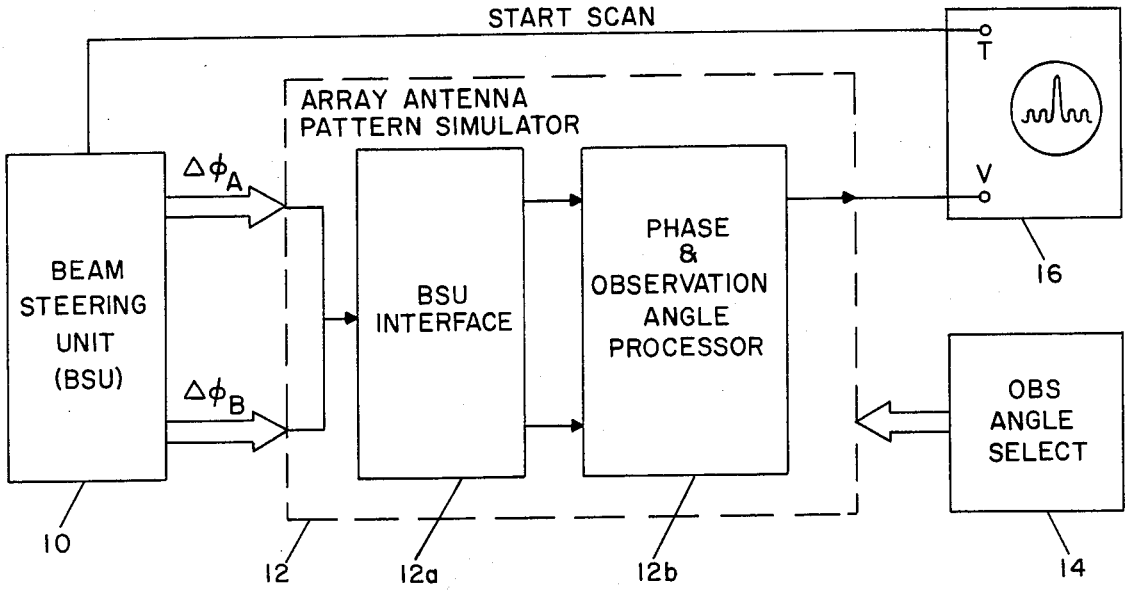
FIG. 1 is a conceptual block diagram of a system for testing operation of a BSU according 12 to the invention.

FIG. 1 represents a technique for monitoring in real time a pattern of wave energy which would be radiated to a given point in space by a phased array antenna which is scanned by a given beam steering unit (BSU) 10. The beam steering unit may be, for example, one which is intended for MLS applications such as, e.g., the type MLS 2600 manufactured by Hazeltine Corporation of Commack, N.Y. The BSU may have separate phase angle data outputs $\phi A$ and $\phi B$ corresponding to differential phase angle information to be conveyed to phase shifters associated with an "A" (elevation) and a "B" (azimuth) side of a MLS phased array antenna. The differential phase data supplied by the BSU 10 during a scanning operation is coupled to an array antenna pattern simulator 12, rather than or in addition to the phase shifters of the MLS antenna. As explained below in regard to FIGS. 2A and 2B, the simulator 12 will appear to the BSU 10 as the phase shifters themselves insofar as the addressing and phase angle data outputting functions of the BSU are concerned.

By processing the phase angle data provided by BSU 10 and observation angle data generated upon setting of an observation angle select switch 14, the simulator 12 provides a digital-to-analog converted output signal which, if connected to the V input of an oscilloscope 16, causes a real time display of a MLS antenna beam were the antenna to be steered by the BSU. A "start scan" signal provided from the BSU 10 to the trigger (T) terminal of the scope 16 thus would cause the display to represent the time at which the main scanning beam of the antenna would be received at an observation point at the selected angle, after the start of a single scan.

Assuming that the phased array antenna to be associated with the BSU 10 comprises a number (e.g., 112) of equally spaced, uniformly illuminated radiating elements, the far-field pattern of the antenna at a point in space at an angle $\theta$ relative to the antenna axis can be represented by $$\Sigma \exp j\left(\frac{2\pi}{\lambda} nd \sin\theta + \phi_n\right)$$

wherein:

n is the element number d is the spacing between elements $\phi_n$ is the relative phase shift introduced to the nth element by its associated phase shifter, and $\lambda$ is the wavelength of energy to be radiated by the antenna.

Expansion of the foregoing yields:

$$\Sigma (\cos x_n + j \sin x_n),$$

$$\text{where: } x_n = 2\frac{\pi}{\lambda} nd \sin\theta + \phi_n.$$

The relative power at the observation point $\theta$ thus may be expressed as:

$$|\Sigma\cos x_n|^2 + |\Sigma\sin x_n|^2.$$

By obtaining a continuous real time summation of the values for the $\cos(x_n)$ and the $\sin(x_n)$ for all the antenna elements or phase shifters n, squaring the sums and then summing the squares, the relative power radiated by the antenna to the far-field observation point at the set angle $\theta$ is obtained. Each of the $\phi_n$ may be changed or updated at a rate of, e.g., 5 MHz or every 200 nanoseconds as in the MLS 2600 BSU. The summations must therefore be performed, then squared and added to one another as the values are updated to enable a faithful reproduction of the scanning pattern which would be obtained at the observation point.

Figure 2A:
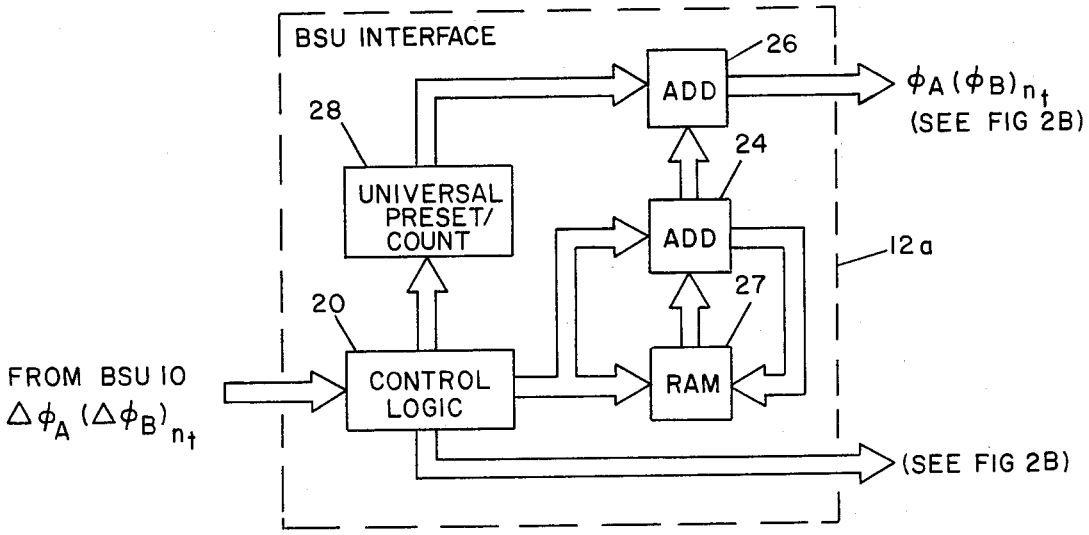
FIG. 2A is a block diagram of a BSU interface portion 12*a* of an antenna pattern simulator 12 according to the invention.
Figure 2B:
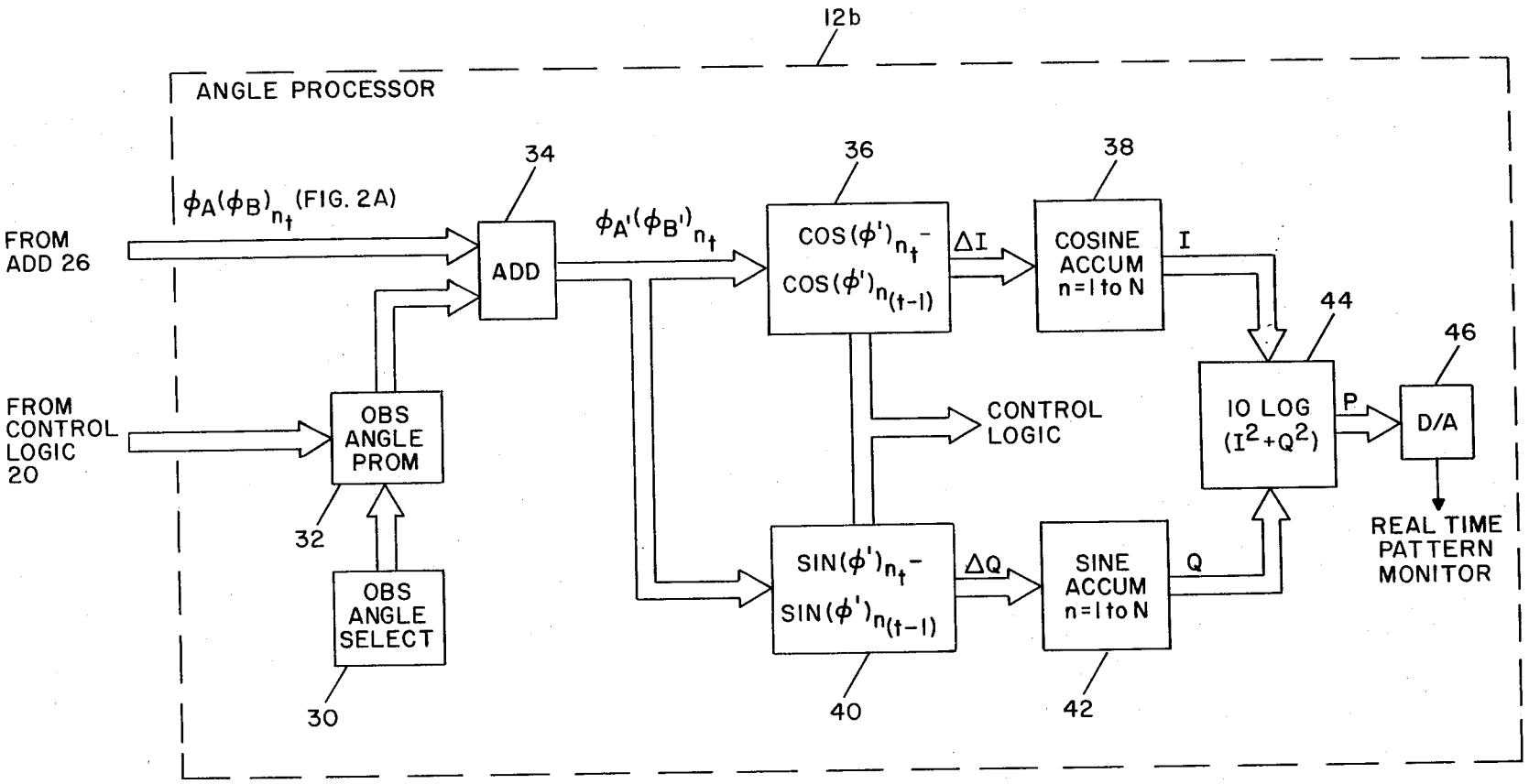
FIG. 2B is a block diagram of a phase angle and observation angle processing portion 12*b* of the present antenna pattern simulator 12.

The antenna pattern simulator 12 of FIGS. 2A and 2B performs the necessary operations on the phase angle data from the BSU 10 as updated, without the requirement for a large summing network having inputs e.g., 112) corresponding to the settings of phase shifters coupled to the BSU output.

The BSU interface portion 12*a* of FIG. 2A includes control logic 20 for buffering the output from the BSU 10 and supplying it to a random access memory 22 having memory areas the addresses of which correspond to phase shifters which would be driven by the BSU 10 when operating with a phased array antenna. As mentioned, the BSU 10 provides only differential phase angle data, i.e., data indicative of the change, if any, to be made to a particular phase shifter setting from the setting of the immediately preceding update interval. In actual practice, the BSU 10 provides initial absolute value phase shift settings for each of the n phase shifters, followed by differential data in, e.g., 22 ½° increments to alter the phase shifter settings up or down in certain time intervals. In FIG. 2A, the initial setting phase angle data is transferred through control logic 20 directly to the memory areas of RAM 22 corresponding to the phase shifters to be set. The contents of the memory areas are then successively added in adder 24 to any differential phase angle data produced by BSU 10 as passed by control logic 20 to a second input of adder 24. Since no differential data is provided at the start of a scan, the initial phase shifter setting data is unaffected and passed to an input of a second adder 26. The remaining input of adder 26 is coupled to a universal preset/count circuit 28 which provides a function corresponding to one which is available on MLS antennas and well-known in the art. The adder 26 and circuit 28 may, however, be eliminated in some cases.

When the first differential data for a phase shifter n is provided from BSU 10, it is routed to adder 24 wherein the previous (or initial) phase angle data for the phase shifter n is incremented according to the differential data. The result is stored at the memory area corresponding to the phase shifter n in the RAM 22, and provided to the second adder 26 or directly as output data corresponding to the absolute phase shift value set in each phase shifter n during a time interval t.

Each time new differential data for a phase shifter n is produced by the BSU 10, it is combined in the adder 24 with the immediately previous absolute phase shift value as stored in the corresponding memory area in RAM 22, and the thus incremented (or decremented) absolute value data is rewritten in the same memory area while being provided as output data from the interface portion of FIG. 2.

FIG. 2B is a phase shifter angle and observation angle processing portion 12*b* of an antenna pattern simulator 12 according to the invention.

An observation angle select circuit 30 which may be in the form of DIP switches is connected to a programmable observation angle memory (PROM) 32. PROM 32 provides an output corresponding to the sine of the selected observation angle $\theta$ multiplied by the antenna element spacing d, the factor $2\pi/\lambda$, and the phase shifter number n. The result is combined in adder 34 with the absolute phase setting for each phase shifter n to produce composite phase angle data for the phase shifter n at a given update interval t. In order to carry out the required summations of the cosine and the sine of the composite angle data, differences between the cosine of said data for a phase shifter n at a time interval t and the data for the same phase shifter n at the immediately preceding time interval (t−1) are determined by cosine circuit 36 and supplied for each of the phase shifters to a cosine accumulator circuit 38. A sine subtraction circuit 40 and sine accumulator circuit 42 carry out similar operations for the required sine summation. An output I of cosine accumulator 38 corresponds to the sum of the in-phase field contributions of each phase shifter (antenna element) n at a far-field point at the selected observation angle. An output Q of the sine accumulator 42 corresponds to the quadrature far field effects of the antenna elements as combined. By squaring each of the I and Q outputs, summing the squares and taking the Log of the result, a signal P corresponding to the relative power at the observation point during a scanning operation of the BSU 10 is produced. Since the signal P is in digital form, it may be necessary to provide a D/A converter 46 to provide a corresponding analog signal for observation and/or further processing.

It will be appreciated that in accordance with the invention, the absolute phase angle settings for each of a great number of phase shifters is stored in corresponding memory areas of the RAM 22. The in-phase and quadrature far field effect of each phase shifter at a certain observation angle is determined and accumulated in the accumulators 38, 42 at the start of a scanning operation of the BSU 10. As differential phase angle data is produced by the BSU 10, the previous field contribution of each phase shifter is subtracted by the circuits 36, 40 from the new contribution and the result accumulated.

A highly desirable instrument for monitoring the operation of phased array antennas with a particular beam steering unit is disclosed herein, with a relatively small amount of circuit devices required for its implementation.

While the foregoing description represents a preferred embodiment of the invention, it will be obvious to those skilled in the art that various changes and modifications may be made, without departing from the true scope and spirit of the invention.

What is claimed is:

1. A method of simulating the pattern of wave energy which would be radiated to an observation point in space from a scanning phase array antenna during operation of an associated beam steering unit, the beam steering unit providing phase angle data at certain time intervals to set a number of phase shifters associated with elements of the phased array antenna, comprising the steps of:

storing initial phase angle data in memory areas each of which corresponds to a phase shifter to be driven by the beam steering unit;

sequentially reading out phase angle data from said memory areas and updating the phase angle data from each memory area in accordance with the pahse angle data from the beam steering unit, and storing the updated phase angle data in the corresponding memory areas over each successive time interval;

selecting a desired observation angle relative to the antenna at which the pattern of wave energy radiated from the antenna to a point in space at said selected observation angle is to be simulated during scanning operation of the beam steering unit;

generating observation angle data which is functionally related to the selected observation angle, the distance between adjacent antenna elements and the wavelength of the wave energy;

combining the update phase angle data for each time interval with the observation angle data and producing composite angle data which is a function of the combined data;

subtracting from the composite angle data for each time interval the composite angle data for the immediately preceding time interval and accumulating resulting differencees with initial value composite angle data to provide accumulated composite angle data; and determining the relative amplitude of wave energy which would be radiated to the point in space at the selected observation angle during operation of the beam steering unit as a function of the accumulated composite angle data.

2. The method of claim 1, wherein the step of producing the composite angle data includes generating separate data corresponding to the cosine and the sine of the combined updated phase angle data and observation angle data, thereby generating composite cosine data and composite sine data.

3. The method of claim 2, wherein said subtracting and accumulating step includes:

subtracting from the composite cosine data for each time interval the composite cosine data for the immediately preceding time interval and accumulating resulting differences with initial value composite cosine data to provide accumulated composite cosine data, and subtracting from the composite sine data for each time interval the composite sine data for the immediately preceding time interval and accumulating resulting differences with initial value composite sine data to provide accumulated composite sine data.

4. The method of claim 3, wherein said relative amplitude determining step includes:

squaring the accumulated composite cosine data, squaring the accumulated composite sine data, and adding the squared accumulated composite cosine data to the squared accumulated composite sine data.

5. The method of claim 1, including comparing the determined relative amplitude of wave energy with a preset pattern during a scanning operation of the beam steering unit, and providing an indication when a certain difference between the determined amplitude and the preset pattern is exceeded.

6. The method of claim 5, including selecting a number of different observation angles and performing said comparing step for each of the selected observation angles.

7. A system for testing the operation of a beam steering unit by simulating the pattern of wave energy which would be radiated to an observation point in space from a scanning phased array antenna including phase shifters associated with substantially equally spaced elements of the antenna, the beam steering unit providing phase angle data at certain time intervals to set the phase shifters over a scanning operation, comprising:

memory means for storing phase angle data in memory areas each corresponding to a phase shifter to be driven by the beam steering unit;

logic means coupled to said memory means and adapted to be responsive to the phase angle data provided by said beam steering unit, for addressing and controlling data flow into and out of said memory areas, said logic means including means for setting initial phase angle data in the areas of said memory means to correspond with initial phase settings for the phase shifters prior to a scanning operation of the beam steering unit;

data increment means coupled to said memory means for updating the value of phase angle data when read out of each of said memory areas in accordance with the phase angle data from the beam steering unit, the updated phase angle data being stored in the corresponding memory area by said logic means for each successive time interval;

means for generating observation angle data in accordance with a selected observation angle at which said observation point is located relative to the antenna, said observation angle data being functionally related to the selected observation angle, the spacing between adjacent antenna elements and the wavelength of the wave energy;

means coupled to said data increment means and said observation angle data generating means for combining the updated phase angle data for each time interval with the observation angle data, and for producing composite angle data which is a function of the combined data;

means for subtracting from the composite angle data for each time interval the composite angle data for the immediately preceding time interval;

means coupled to said subtracting means for accumulating resulting differences with initial value composite angle data to produce accumulated composite data; and means coupled to said accumulating means for determining the relative amplitude of wave energy which would be radiated to said observation point during a scanning operation of the beam steering unit in accordance with said accumulated composite angle data, and for producing a corresponding output.

8. A system according to claim 7, wherein said combining and producing means includes means for producing separate data corresponding to the cosine and the sine of the combined updated phase angle data and observation angle data, to define composite cosine data and composite sine data.

9. A system according to claim 8, wherein said subtracting means includes:

first means for subtracting from the composite cosine data for each time interval the composite cosine data for the immediately preceding time interval, and second means for subtracting from the composite sine data for each time interval the composite sine data for the immediately preceding time interval, and said accumulating means includes:

cosine accumulator means coupled to said first means for accumulating resulting differences with initial value composite cosine data to produce accumulated composite cosine data, and sine accumulator means coupled to said second means for accumulating resulting differences with initial value composite sine data to produce accumulated composite sine data.

10. A system according to claim 9, wherein said relative amplitude determining means includes means for generating the square of said accumulated composite cosine data, means for generating the square of said accumulated composite sine data, and means for adding together the generated squares of said data.

11. A system according to claim 7, including means for storing a preset antenna pattern, means for comparing the output of said determining means with said preset antenna pattern during a scanning operation of the beam steering unit, and means for indicating when a certain difference between said output and said preset pattern is exceeded.

* * * * *